US006665507B1

(12) United States Patent
Hooper, III et al.

(10) Patent No.: US 6,665,507 B1
(45) Date of Patent: Dec. 16, 2003

(54) METHODS AND DEVICES FOR SPACING COMPONENTS OF AN ELECTROPHOTOGRAPHIC PRINTER

(75) Inventors: Howard G. Hooper, III, Boise, ID (US); K. Trent Christensen, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/219,240

(22) Filed: Aug. 14, 2002

(51) Int. Cl.[7] ..... G03G 21/16; G03G 21/18

(52) U.S. Cl. ..... 399/110; 399/115; 399/119; 399/121

(58) Field of Search ..... 399/110, 115, 399/119, 121, 302, 227

(56) References Cited

U.S. PATENT DOCUMENTS

| | | | | |
|---|---|---|---|---|
| 5,666,608 A | | 9/1997 | Christensen | |
| 5,991,580 A | * | 11/1999 | Byeon | 399/227 |
| 6,212,351 B1 | * | 4/2001 | Kawagoe et al. | 399/302 |
| 6,385,420 B1 | * | 5/2002 | Morioka | 399/115 |

FOREIGN PATENT DOCUMENTS

| | | | |
|---|---|---|---|
| JP | 4-172464 A | * | 6/1992 |
| JP | 7-160095 A | * | 6/1995 |
| JP | 11-65333 A | * | 3/1999 |
| JP | 2000-320537 A | * | 11/2000 |
| JP | 2002-108113 | * | 4/2002 |

* cited by examiner

*Primary Examiner*—Joan Pendegrass

(57) ABSTRACT

An electrophotographic printer including a transfer roller having a first movable spacer for temporarily creating a gap between the transfer roller and a photo conductor.

35 Claims, 10 Drawing Sheets

METHODS AND DEVICES FOR SPACING COMPONENTS OF AN ELECTROPHOTOGRAPHIC PRINTER

FIELD OF THE INVENTION

This invention relates to the field of electrophotographic image printing systems. More particularly, the present invention relates to apparatus and methods for preventing damage to printing cartridge and printer components prior to first use.

BACKGROUND OF THE INVENTION

Laser printers have become the printers of choice for most businesses and many individuals. Laser printers typically produce text and graphics of excellent quality at relatively high speeds.

Modern laser printing is generally accomplished by what is commonly known as the electrophotographic process. At the heart of the imaging process is an organic photoconductive (OPC) drum. The drum typically includes an extruded aluminum cylinder coated with a non-toxic organic photoconductive material. There are six generalized stages to the electrophotography process: cleaning, conditioning, writing, developing, transferring and fixing.

Cleaning is the first stage in the imaging process. This stage prepares the OPC drum to receive a new latent image by applying a physical and electrical cleaning process. The physical cleaning of the OPC is typically accomplished by a drum cleaning blade (or wiper blade) and a recovery blade. The wiper blade scrapes any excess toner from the drum and the recovery blade catches the toner and sweeps it into a waste hopper. In the electrical aspect of cleaning, the previous image on the drum must be cleared before a new one may be applied. The electrical cleaning of the OPC drum is performed by erasure lamps (usually corona wire technology) or a primary charge roller (PCR), which eliminate the previous latent image from the drum.

After the drum has been cleaned, it must be conditioned or charged to accept the image from the laser. A primary corotron (corona wire or PCR) applies a uniform negative charge (usually in the range of −600V to −720 V DC) to the surface of the drum.

Following the conditioning stage is the writing stage. In this stage, a laser beam is used to discharge a conditioned charge to the drum surface. The conditioned charge creates a latent image on the drum. An aluminum base is connected to an electrical ground and the photoconductive material comprising the OPC becomes electrically conductive to ground when exposed to light (generally a laser). Therefore, the negative charges deposited onto the surface of the drum conduct to the aluminum base when exposed to light, creating the latent image. The latent image area will attract toner in a later stage.

The fourth stage is developing. At this stage, the latent image becomes a visible image. This stage generally requires four major components: toner, a developer roller assembly, a metering blade, and an AC/DC charge. Toner is attracted to the developer roller either by an internal magnet or by an electro-static charge. The roller carries the toner particles to a metering blade (a/k/a a doctor blade), where toner tumbles and creates a tribo-electric charge (friction) on the surface of the toner particles. The metering blade then provides for an evenly distributed amount of toner to pass to the OPC drum. Once the toner particle has passed beyond the doctor blade, it is ready to be presented to the OPC drum. The developer roller is then charged with an AC/DC charge from the High Voltage Power Supply. This charge allows the toner particles to "jump" from the developer roller and travel to the OPC drum where it is attracted to the latent image.

At this point, the toner image on the drum is transferred onto a sheet of paper. As the paper is passed under the OPC drum, it is passing over a transfer corotron assembly. The transfer corotron assembly includes a transfer roller and places a positive charge on the back of the page, attracting the toner from the drum.

The sixth and final stage is fixing. Also known as fusing, this is the stage in which the toner is permanently affixed to the paper. The fuser assembly typically includes a heated roller, a pressure roller, a heating element, a thermistor, a thermal fuse, and, sometimes, a cleaning pad. The heating element is typically placed inside the heated roller, which is usually constructed of aluminum with a teflon coating. The roller is heated to approximately 350° F. (180° C.). The second roller is usually a rigid foamed silicon rubber. This second roller applies pressure to the heated roller. The paper passes between the two rollers and the heated roller melts the toner particles while the pressure roller presses the toner into the fiber weave of the paper.

In many laser printers, the OPC drum, PCR, developer roller, and toner particles are part of a disposable cartridge that can be replaced from time to time as the supply of toner is exhausted. Most often, when a laser printer is transferred from one place to another, the laser printer does not include an installed cartridge. The primary reason cartridges are not installed during transport is to prevent damage to cartridge components, printer components, or both. When a cartridge is properly installed in a laser printer, there are sensitive interfaces between the PCR and the OPC; and between the OPC and the transfer roller. In some printers, there may also be a sensitive interface between the developer roller and the OPC. Even with carefully packaged printers, rough handling of a laser printer with an installed cartridge can damage the PCR, OPC, and/or the transfer roller. The interface spacing and tolerances may also be compromised during shipping and handling, which may reduce image quality. Therefore, it is uncommon at present to ship laser printers with cartridges installed.

Further, for color laser printers there may be additional sensitive interfaces that may be damaged during shipping and handling with a toner cartridge installed. The additional surfaces may include interfaces between an intermediate transfer drum or belt and the OPC, and the intermediate transfer drum or belt and a secondary transfer roller.

However, because many users prefer to have a cartridge immediately available when a laser printer is purchased, the packaging of new laser printers often includes a separate cartridge not installed in the printer. For example, it is common to ship new laser printers in a configuration shown in FIG. 1, with a printer (22), a cartridge (20), and one or more printer accessories (14) housed in a box (16) but separate from one another. The packaging for printer (22), cartridge (20), and printer accessories (14) also commonly includes some sort of outer material such as polystyrene or bubble wrap to reduce handling shock.

The arrangement shown in FIG. 1, however, requires a much larger box (16) than the dimensions of printer (22) and accessories (14) alone would require. In addition to the higher environmental and economic costs associated with larger boxes, shipping expenses are increased because of the large box size. Because most bulk shipping rates are priced on volume—rather than mass—shipping costs for laser printers could be significantly reduced by installing the cartridge in the printer before shipment and housing the printer and cartridge in a smaller box. However, the risk of damage to printer and cartridge components has presently outweighed the potential benefit to lower shipping and packaging costs in most instances.

SUMMARY OF THE INVENTION

The present invention provides, among other things, an electrophotographic printer including a transfer roller having a first movable spacer for temporarily creating a gap between the transfer roller and a photo conductor.

The present invention also provides a method of packaging an electrophotographic printer for shipment including inserting a toner cartridge into the electrophotographic printer with a first self-removing spacer between a transfer roller and a photoconductive drum prior to shipment.

BRIEF DESCRIPTION OF THE DRAWINGS

The foregoing and other features and aspects of the invention will become further apparent upon reading the following detailed description and upon reference to the drawings in which.

Throughout the drawings, identical reference numbers designate similar, but not necessarily identical, elements.

Figure 1:
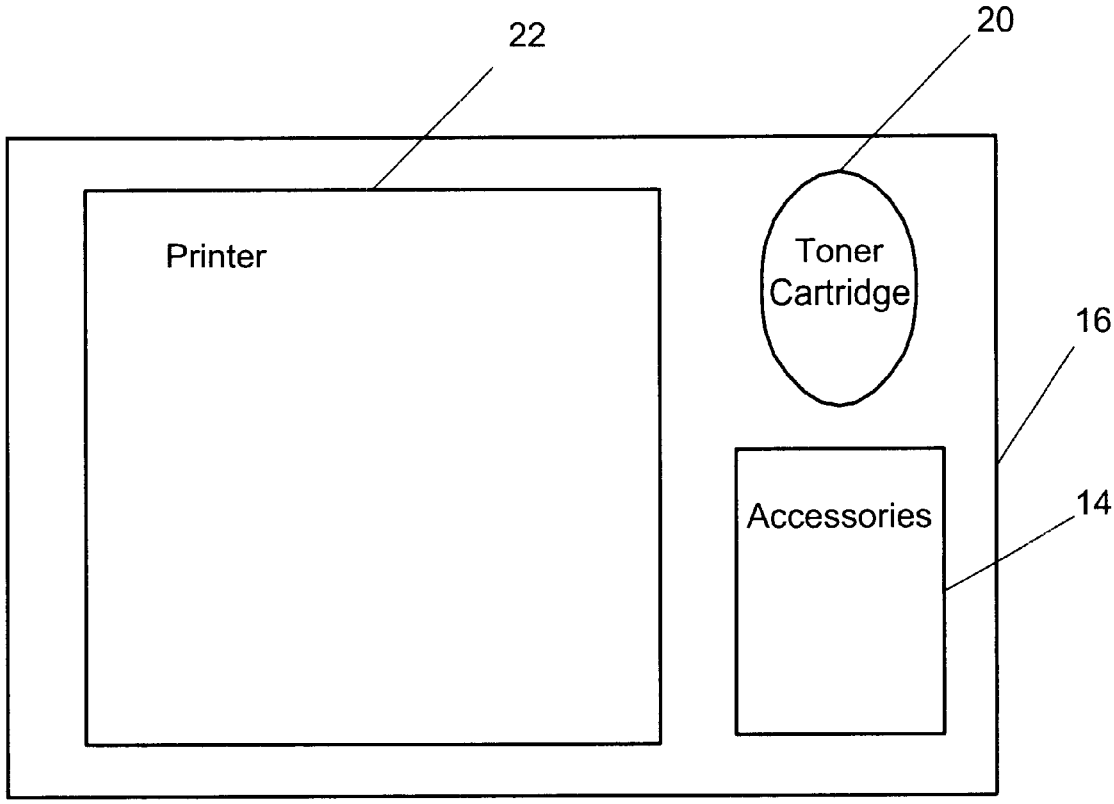
FIG. 1 (Prior Art)
FIG. 1 is a representative view of a printer packaging arrangement.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE EMBODIMENTS

Illustrative embodiments of the invention are described below. As will be appreciated by those skilled in the art, the present invention can be implemented in a wide variety of printing devices including, but not limited to, laser printers, facsimile machines, copiers, plotters, etc. As used herein, and in the appended claims, the term "printer" is defined to mean any device that outputs a hard-copy document on paper or some other print medium, including, but not limited to, those printing devices mentioned above Turning now to the drawings, and in particular to FIG. 2, an electrophotographic printing system (18) according to one embodiment of the present invention is shown. The electrophotographic printing system (18) shown is representative of a black-and-white printer. The electrophotographic printing system (18) may include a cartridge such as a toner cartridge (20) housed within a laser printer (22). The toner cartridge (20) may include a charging member such as a primary charging roller (PCR) (24) adjacent to a photo conductor or photoconductive drum, such as an organic photo conductor (OPC) (26). As discussed above, the PCR (24) erases any images written on the OPC (26) by a laser (28). In operation, the OPC (26) must contact the PCR (24) for proper printing to take place. The toner cartridge (20) may also include a developing cylinder (30). The operation of the PCR (24), the OPC (26), and the developing cylinder (30) are discussed above. In some embodiments, the developing cylinder (30) is a compliant member made of an elastomer or other material and is in contact with the OPC (26). In embodiments where the developing cylinder (30) is in contact with the OPC (26), toner may be transferred from the developing cylinder (30) to the OPC (26) without jumping the gap normally present between the developing cylinder (30) and the OPC (26).

When inserted into the laser printer (22), the OPC (26) of the toner cartridge (20) is normally adjacent to and may contact a transfer roller such as a transfer charging roller (32). While the OPC (26) is shown in the present embodiment as a component of the toner cartridge (20), in some embodiments the OPC (26) is part of the laser printer (22). The OPC (26) may be any convenient size, for example the OPC (26) may have a diameter of approximately 20–60 mm.

Figure 2:
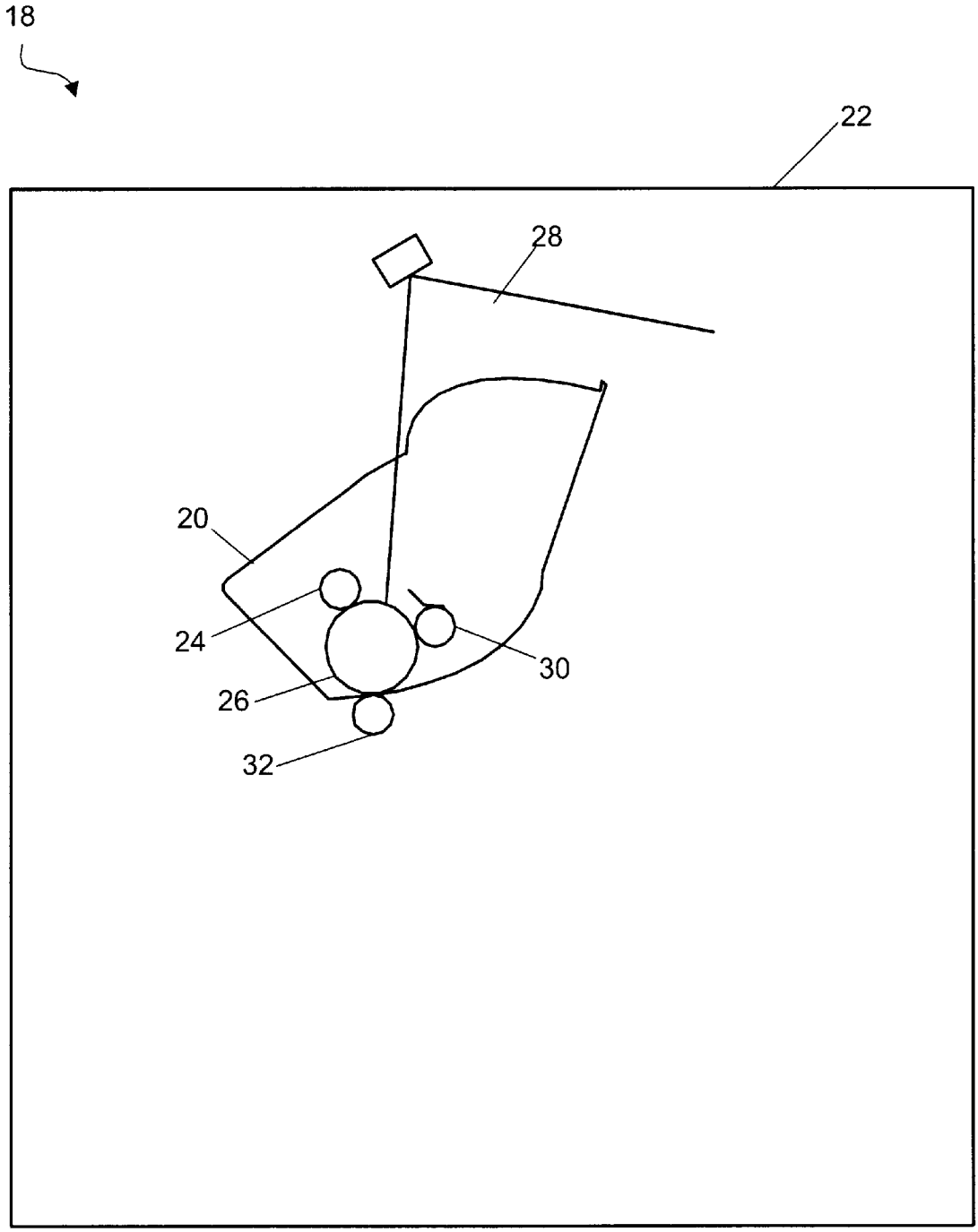
FIG. 2 is a side view of a printer and cartridge according to one embodiment of the present invention.

As discussed above, the transfer charging roller (32) transfers toner from the developing cylinder (30) to a print media such as paper (not shown). Therefore, although the transfer charging roller (32) and the OPC (26) may be at times in contact with one another, the configuration still allows for paper to be inserted therebetween when the toner cartridge (20) is properly installed. The transfer charging roller (32) is shown in FIG. 2 as a component of the laser printer (22), however, in some embodiments the transfer charging roller (32) may be incorporated into the toner cartridge (20).

Figure 3:
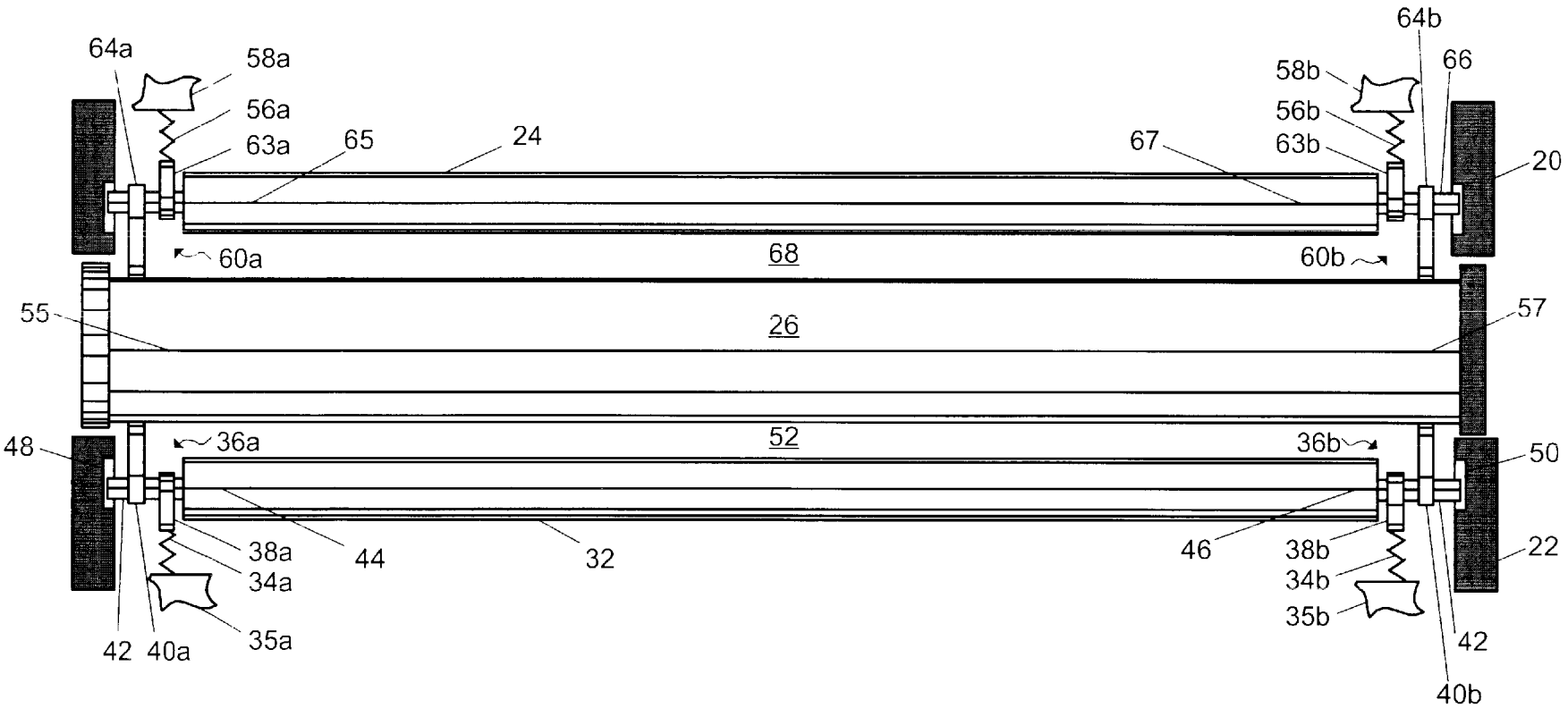
FIG. 3 front view of printer and cartridge components according to one embodiment of the present invention.

To facilitate a close fit or contacting relation between the transfer charging roller (32) and the OPC (26) during printing operations, the transfer charging roller (32) may be urged toward the OPC (26) by one or more biasing members, for example a pair of springs (34*a* and 34*b*) shown in FIG. 3. the springs (34*a* and 34*b*) may be disposed between the transfer charging roller (32) and a pair of spring bosses (35*a* and 35*b*, respectively). However, during shipment of the laser printer (22), the sensitive surfaces of the transfer charging roller (32) and/or the OPC (26) are prone to damage if the cartridge (20) is installed in the laser printer (22) with the transfer charging roller (32) and the OPC (26) in contact or very close proximity to one another. The damage to the transfer charging roller (32) and/or the OPC (26) may result from rough handling and vibrations during shipment that may cause collisions between the transfer charging roller (32) and the OPC (26). Therefore, according to the embodiment of FIG. 3, a movable spacer (36*a*) may be used to temporarily create a gap (52) between the transfer charging roller (32) and the OPC (26).

In the embodiment of FIG. 3, two movable spacers (36*a* and 36*b*) are shown. The two movable spacers (36*a* and 36*b*) may include spacer members (38*a* and 38*b*, respectively) and cams such as floating cams (40*a* and 40*b*, respectively). The floating cams (40*a* and 40*b*) may be made of plastic or other material. The spacer members (38*a* and 38*b*) may be separately or integrally formed with the floating cams (40*a* and 40*b*). The spacer members (38*a* and 38*b*) and the floating cams (40*a* and 40*b*) may include holes for mounting onto a shaft (42) of the transfer charging roller (32).

Prior to the shipment and first use of the laser printer (22) and the toner cartridge (20), the floating cams (40*a* and 40*b*) may engage the OPC (26) and lift the transfer charging roller (32) off the surface of the OPC (26). The resulting gap (52) is created by the lifting of the transfer charging roller (32) from the OPC (26). Photoconductive drums such as the OPC (26) may include non-coated areas at each of first and second ends (55 and 57) that are not photo-sensitive. The non-coated areas may be in the range of about 0.25 to 5 cm in some embodiments, 0.5 to 3 cm in other embodiments, and about 2 cm in still other embodiments. The Floating cams (40*a* and 40*b*) may accordingly be arranged at a pair of ends (44 and 46) such that the engagement of the floating cams (40*a* and 40*b*) with the OPC (26) is only on non-coated areas. However, in some embodiments the floating cams (40*a* and 40*b*) may in fact engage coated areas of the OPC (26).

The transfer charging roller (32) may be mounted within the laser printer (22) by first and second transfer roller slots (48 and 50). The first and second transfer roller slots (48 and 50) are receptive of first and second ends (44 and 46) of the shaft (42). The slots (48 and 50) facilitate sliding movement of the transfer charging roller (32) toward and away from the OPC (26). Therefore, the transfer charging roller (32) may be spaced from the OPC (26) as discussed above by engaging spacers such as the cams (40*a* and 40*b*) with the OPC (26) in a first cam position; or the transfer charging roller (32) may directly engage the OPC (26) by moving the cams (40*a* and 40*b*) to a second cam position discussed below with reference to FIG. 5.

The toner cartridge (20) may also include a charging member such as the primary charge roller (PCR) (24) adjacent to and normally in contact with the OPC (26). Similar to the transfer charging roller (32), to facilitate a contacting relation between the PCR (24) and the OPC (26), the PCR may be urged toward the OPC (26) by one or more biasing members, for example a pair of springs (56*a* and 56*b*) shown in FIG. 3. The springs (56*a* and 56*b*) may be disposed between the PCR (24) and a set of spring bosses (58*a* and 58*b*, respectively). However, during shipment of the laser printer (22), the sensitive surfaces of the PCR (24) and/or the OPC (26) are prone to damage if the cartridge (20) is installed in the laser printer (22) with the PCR (24) and the OPC (26) in contact with one another.

Therefore, according to the embodiment of FIG. 3, a movable spacer may be used to temporarily create a gap (68) between the PCR (24) and the OPC (26).

In the embodiment of FIG. 3, two movable spacers (60*a* and 60*b*) are shown. The two movable spacers (60*a* and 60*b*) may include spacer members (63*a* and 63*b*, respectively) and floating cams (64*a* and 64*b*, respectively). The Floating cams may be made of plastic or other material. The spacer members (63*a* and 63*b*) may be separately or integrally formed with the floating cams (64*a* and 64*b*). The spacer members (63*a* and 63*b*) and the floating cams (64*a* and 64*b*) may include holes for mounting onto a shaft (66) of the PCR (24).

Prior to the shipment and first use of the laser printer (22) and the toner cartridge (20), the floating cams (64*a* and 64*b*) may engage the OPC (26) and lift the PCR (24) off the surface of the OPC (26). The resulting gap (68) is created by the lifting of the PCR (24) from the OPC (26). The floating cams (64*a* and 64*b*) may be arranged at first and second ends (65 and 67) such that the engagement of the floating cams (64*a* and 64*b*) with the OPC (26) is only on non-coated areas at the ends (55 and 57) of the OPC. However, in some embodiments the floating cams (64*a* and 64*b*) may in fact engage coated areas of the OPC (26).

The use of spacers such as the movable spacers (36*a*, 36*b*, 60*a*, and 60*b*) shown advantageously provide gaps between the PCR (24), the transfer charging roller (32) and the OPC (26) such that shipping of the laser printer (22) with the toner cartridge (20) installed therein can be done with a higher expectation of little or no damage to the laser printer (22) or any cartridge components. The cartridge (20) may be filled or re-filled with toner before being inserted into the printer (22) and having the spacers (36, 60) positioned to create the gaps (52, 68). However, the laser printer (22) is not operational in the configuration shown in FIG. 3, and therefore the movable spacers (36*a*, 36*b*, 60*a*, and 60*b*) must be moved or otherwise disengaged prior to printing. Hence, the movable spacers (36*a*, 36*b*, 60*a*, and 60*b*) may each include frictional surfaces such as a surface (70) shown in FIG. 4.

Figure 4:
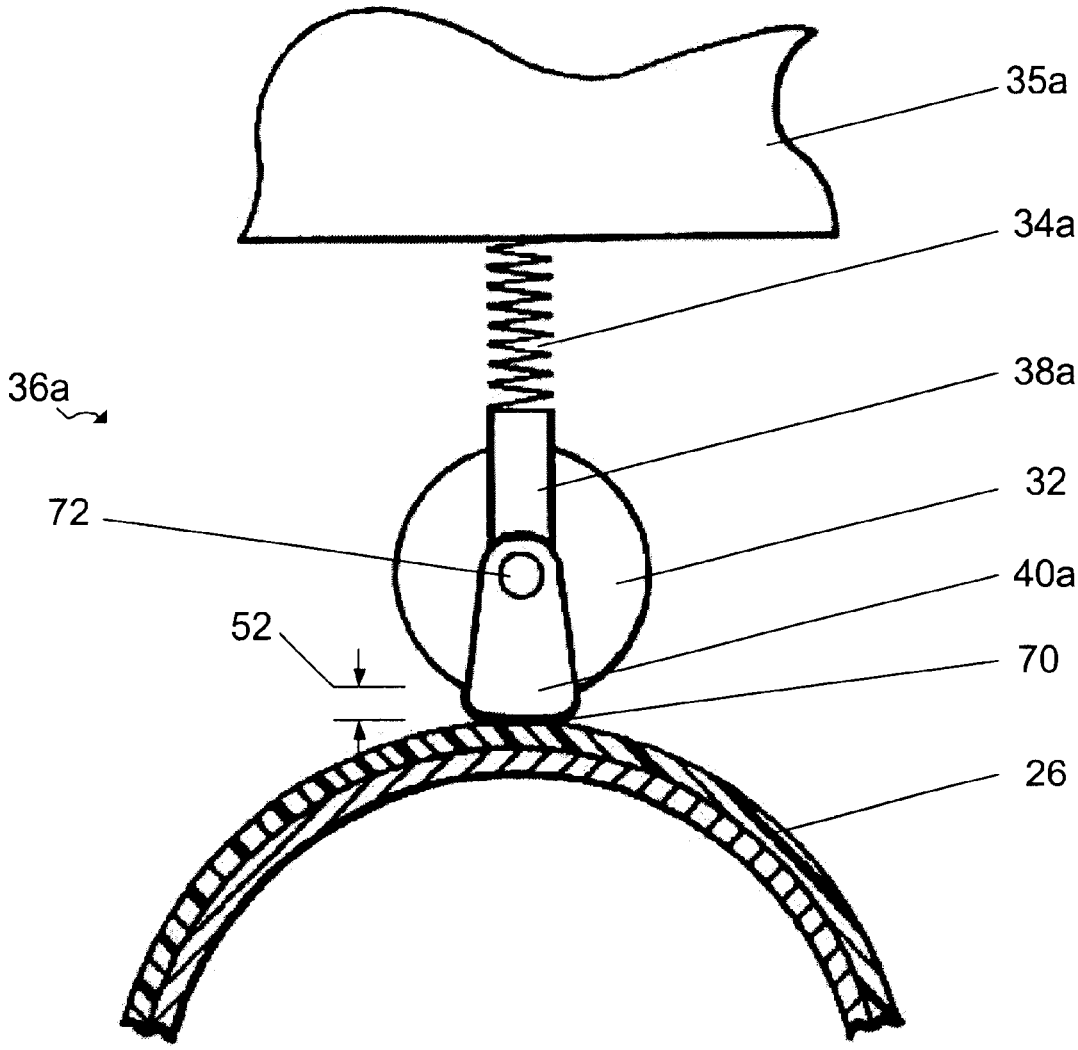
FIG. 4 is side view of printer and cartridge components in a first position according to one embodiment of the present invention.

FIG. 4 shows in side view one movable spacer (36*a*), however, the movable spacers (36*b*, 60*a*, and 60*b*) may all operate similarly. As shown, the surface (70) is formed in the floating cam (40*a*), which is pivotally attached to the transfer charging roller (32). The floating cam (40*b*) is similarly attached to the transfer charging roller (32) at an opposite end. The second set of floating cams (64*a* and 64*b*) are attached to the PCR (24) in a manner similar to the first set of floating cams (40*a* and 40*b*). With the floating cam 40*a* in the first position shown in FIG. 4, the gap (52) prevents contact between the OPC (26) and the transfer charging roller (32) and thus prevents damage to the OPC (26) or the transfer charging roller (32) during shipment or handling prior to use.

However, the laser printer (22) may not operate correctly with the movable spacers (36*a*, 36*b*, 60*a*, and 60*b*) in the first position shown in FIGS. 3–4, therefore, the movable spacers (36*a*, 36*b*, 60*a*, and 60*b*) may automatically move or rotate out of engagement with the OPC (26) upon rotation of the OPC (26). The disengagement of the movable spacers (36*a*, 36*b*, 60*a*, and 60*b*) with the OPC (26) advantageously allows a user to operate the laser printer (22) without rearranging, reinstalling, or removing the cartridge (20; FIG. 2) or any other components prior to first use. The first set of movable spacers (36*a* and 36*b*) may also move or rotate out of engagement with the OPC (26) upon rotation of the transfer charging roller (32). Likewise, the second set of movable spacers (60*a* and 60*b*) may move or rotate out of engagement with the OPC (26) upon rotation of the PCR (24).

The disengagement of the movable spacers (36*a*, 36*b*, 60*a*, and 60*b*) with the OPC (26) may be facilitated by the cams (40*a*, 40*b*, 64*a*, and 64*b*) because the cams have surfaces (70) having a coefficient of friction with the OPC (26) sufficient to overcome the biasing force exerted by the springs (34*a*, 34*b*, 56*a*, and 56*b*) as the OPC (26) rotates.

Figure 5:
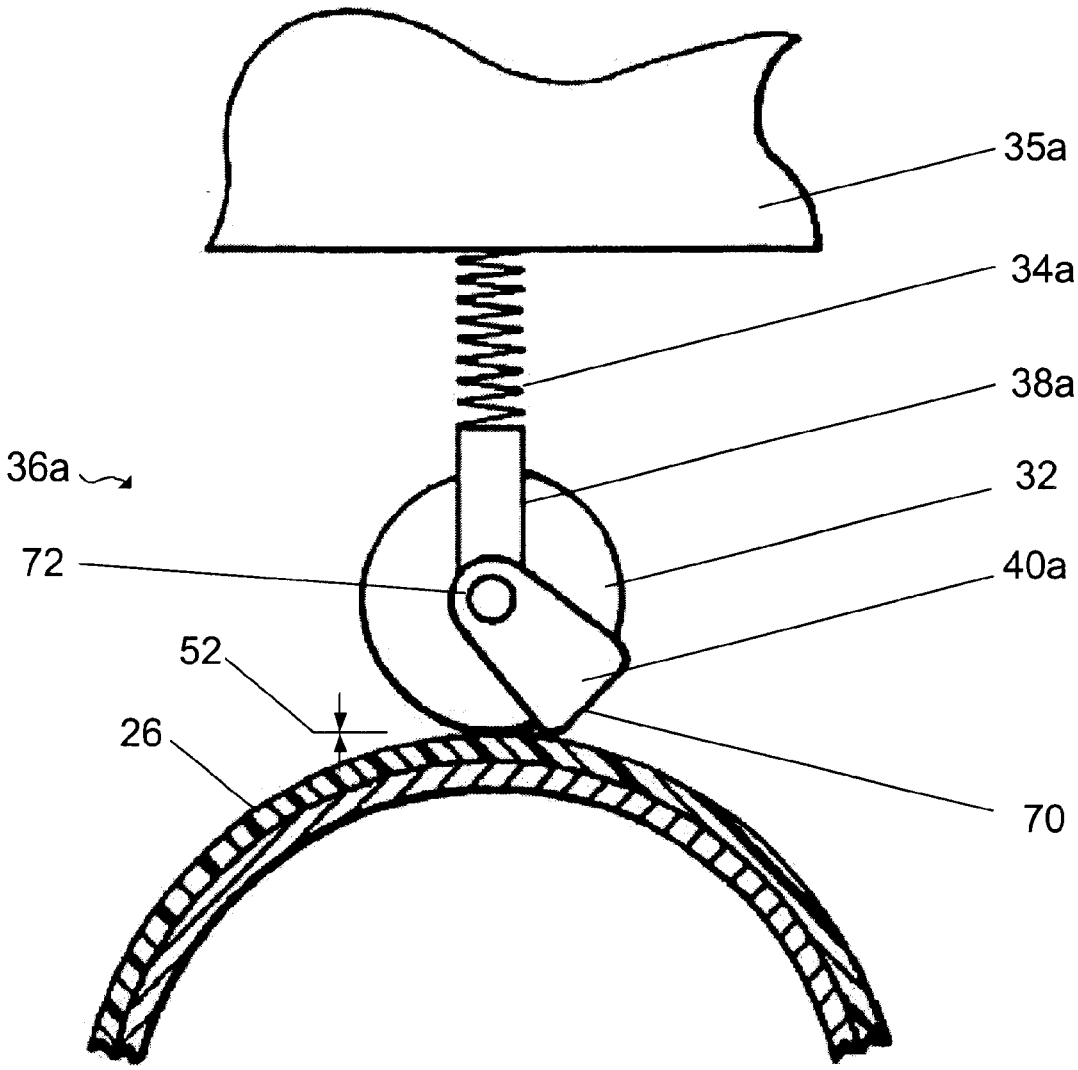
FIG. 5 is a side view according to FIG. 4 in a second position according to one embodiment of the present invention.

Therefore, as the OPC (26) rotates, the cam (40*a*) rotates about a pivot point (72) until it disengages the OPC (26) in a second position as shown in FIG. 5. As the cam (40*a*) rotates out of engagement with the OPC (26), the spring (34*a*) urges the transfer charging roller (32) toward the OPC (26) and the gap (52) is reduced or eliminated. Therefore, a user may simply start using the laser printer (22; FIG. 2), and the OPC (26) will rotate, causing the cam (40*a*) to move from the first position as shown in FIG. 4 to the second position as shown in FIG. 5. When the cam (40*a*) reaches the second position shown in FIG. 5, it may continue to float freely in an unobtrusive manner as the laser printer (22) is used. Likewise, each of the other cams (40*b*, 64*a*, and 64*b*) may also move from first to second positions in the same manner shown and described with reference to the first cam (40*a*). As each of the cams (40*a*, 40*b*, 64*a*, and 64*b*) move from first positions as shown in FIG. 4 to second positions shown in FIG. 5, the laser printer (22) automatically becomes fully operational, and the gaps (52 and 68)—which may be provided to protect the OPC (26) or other components—are reduced or eliminated.

Figure 6:
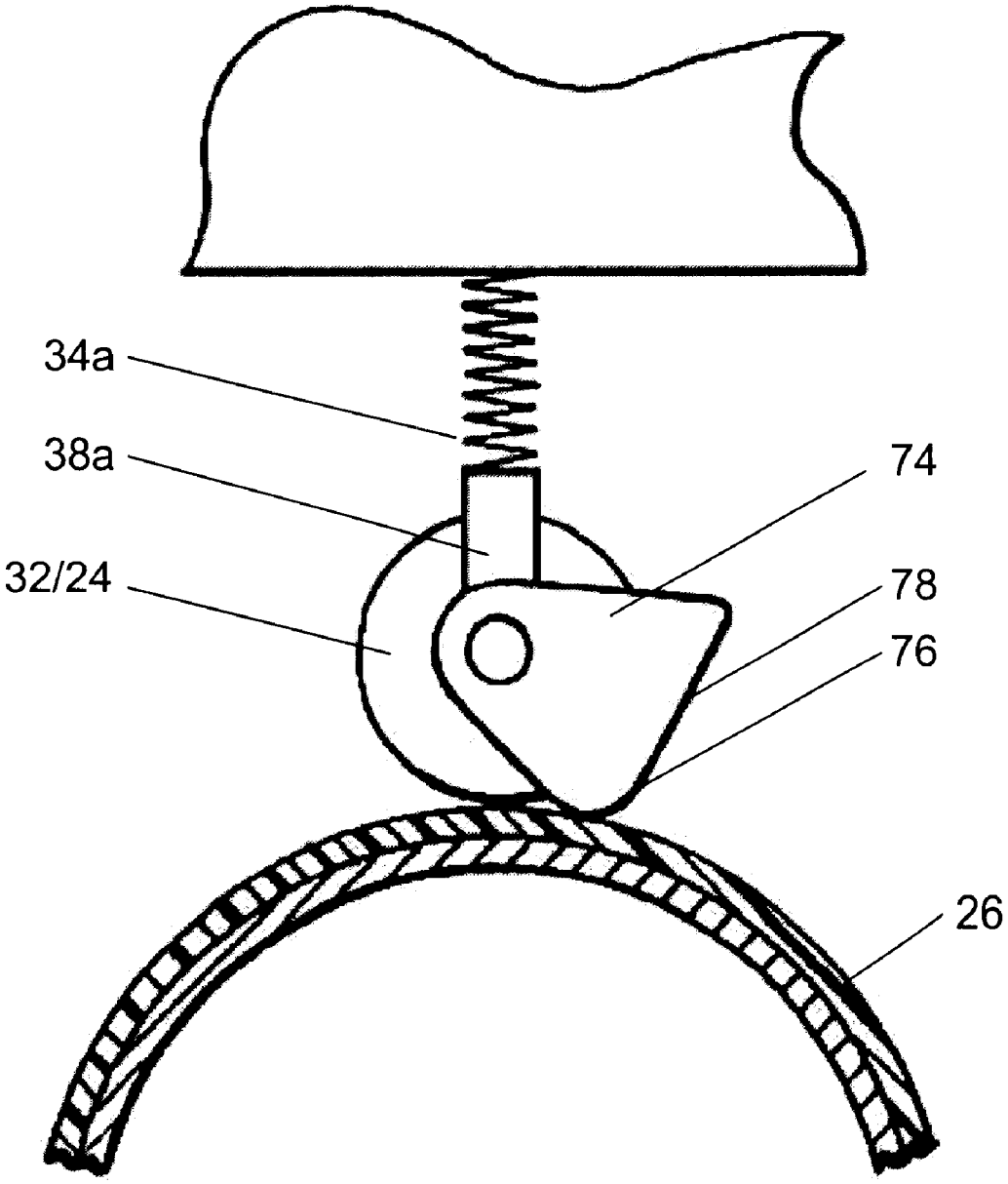
FIG. 6 is a side view of printer and cartridge components according one embodiment of the present invention.

Turning next to FIG. 6, an alternative embodiment of a spacer using a cam is shown in a second or operating position. According to the embodiment of FIG. 6, a cam (74) may have an elliptical corner (76). Similar or identical cams may be found on each end of the transfer charging roller (32) and the PCR (24). According to the elliptical corner (76) shape of the cam (74) shown, the cam (74) may be moved back and forth between a first or pre-use position similar to that shown in FIG. 4 separating the OPC (26) from the PCR (24) and transfer charging roller (32), and a second or operating position shown in FIG. 6. It will be understood by those of skill in the art having the benefit of this disclosure that many other cam shapes may also be used as necessary to move the cams from pre-use positions separating the OPC (26) from the transfer charging roller (32) and the PCR (24), to operating positions reducing or eliminating the separations (and optionally back to pre-use positions). The re-establishment of spacers such as the cam (74) to a pre-use position may be desirable, for example, if the cartridge (20; FIG. 2) is scheduled to be out of use for an extended period of time, or if the printer (22) and the cartridge (20) are to be moved or shipped.

The factors that may be considered in designing the shape and size of a cam may include, but are not limited to: the coefficient of friction between the cam and the OPC (26), the loading force applied by biasing members such as the spring (34*a*), and the radius of the OPC (26). In some embodiments, the coefficient of friction between cams such as the cam (74) and the OPC (26) may be controlled such that the cam (74) does not move from the first or pre-use position until the rotational speed of the OPC (26) approaches the operating rotational rate of the laser printer (22; FIG. 2). According to such embodiments, when the OPC (26) is rotated at speeds substantially below the operating rotational rate, the surface (78) of the cam (74) may slide over the OPC (26) as the OPC (26) rotates. When the rotational speed of the OPC (26) approaches the operating rotational speed, the coefficient of friction may increase to a value causing the cam (74) to rotate to the second or operating position.

Figure 7:
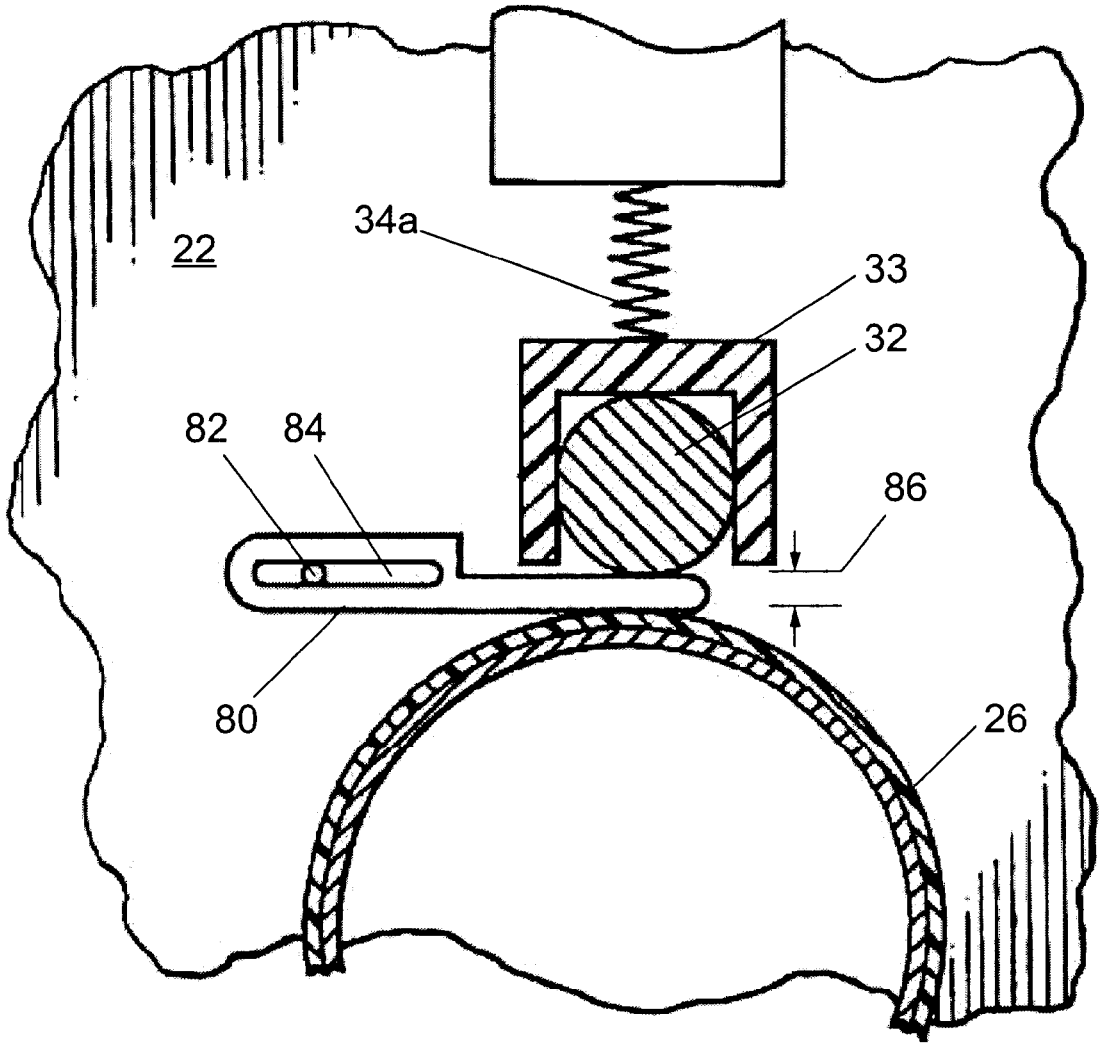
FIG. 7 is a side view of printer and cartridge components according to one embodiment of the present invention.

Turning next to FIG. 7, another alternative embodiment for a movable spacer between the transfer charging roller (32) and the OPC (26) and/or between the PCR (24) and the OPC (26) is shown. According to the embodiment shown, the movable spacer is a removable insert (80) that may be slidably mounted on a pin (82). The pin (82) may be attached to the printer (22). The removable insert (80) may include a slot (84) through which the pin (82) may be inserted to constrain the movement of the removable insert (80). The removable insert (80) may be made of Mylar®, plastic or other materials.

In the first or pre-use position, the removable insert (80) is inserted between the transfer charging roller (32) and the OPC (26) to create a gap (86), which may protect the OPC (26) and the transfer charging roller (32) from damage during shipping or handling. The transfer charging roller (32) may be supported by a holder (33). When the OPC (26) is rotated, frictional forces between the surface of OPC (26) and the removable insert (80) move the removable insert (80) out from between the OPC (26) and the transfer charging roller (32), allowing the spring (34*a*) to urge the transfer charging roller (32) toward the OPC (26). Similar or identical removable inserts (80) may be used at each end of the transfer charging roller (32) and PCR (24).

In alternative embodiments, the removable insert (80) may not be constrained by the pin (82) but may instead be independent of the laser printer (22) and the cartridge (20; FIG. 2). Accordingly, the removable insert (80) may simply be forced out from between the transfer charging roller (32) and the OPC (26) and/or the PCR (24) and the OPC (26); and fall harmlessly into a laser printer housing or a cartridge housing.

Figure 8:
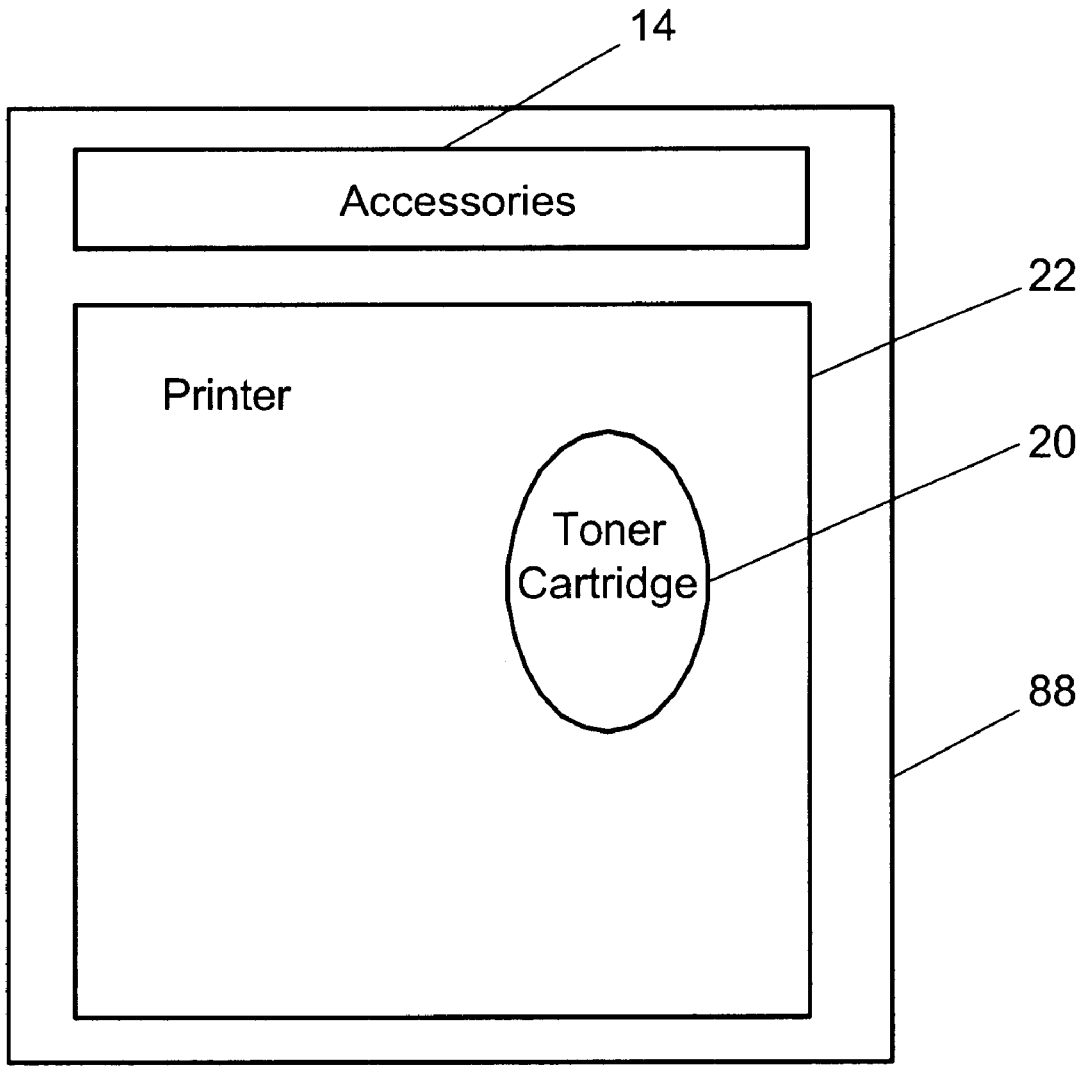
FIG. 8 is a representative view of a printer packaging arrangement according to one embodiment of the present invention.

As discussed briefly above, one of the advantages of the spacers of the present invention may be the packaging of laser printers for shipment. Referring to FIG. 8, the laser printer (22) may have the toner cartridge (20) installed therein allowing for a reduction in the volume of a box (88) by a substantial margin over the usual shipping containers shown in FIG. 1. The box (88) shown in FIG. 8 may be 20% smaller or more than the box (16) of FIG. 1, reducing materials and shipping costs. Therefore, shipping and packaging costs may be reduced while still ensuring that the laser printer (22) and the cartridge (20) reach their destinations without damage to the OPC, transfer roller, or PCR. In addition, the end user will not be required to install the toner cartridge (20) in the laser printer (22) prior to use because the cartridge will already be installed and the ready for printing.

Figure 9:
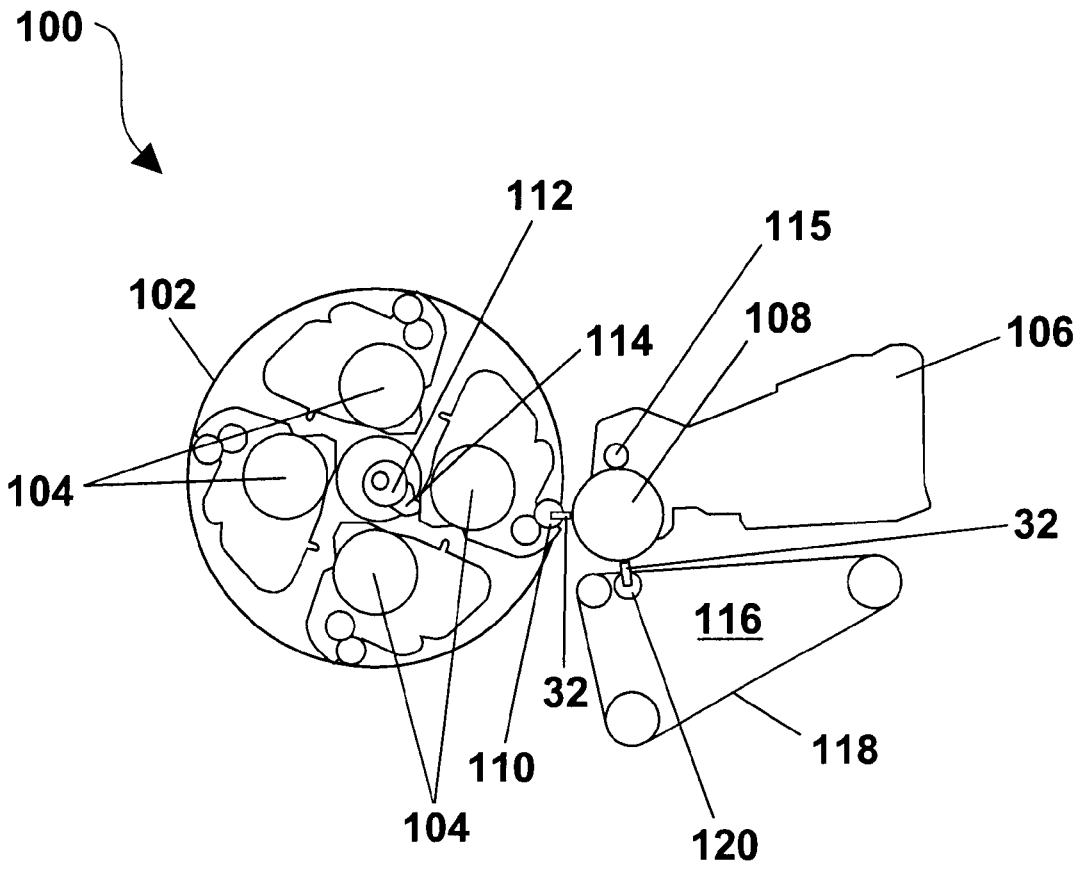
FIG. 9 is a representative view of a color laser printing apparatus according to one embodiment of the present invention.

Referring next to FIG. 9, another embodiment of the present invention is shown. According to the embodiment of FIG. 9, there is a representation of a color laser printing apparatus (100). The color laser printing apparatus (100) includes a toner cartridge carousel (102) with two or more color toner cartridges (104) disposed in the toner cartridge carousel (102). In the present embodiment, the toner cartridges (104) may include black, yellow, magenta, and cyan cartridges. Each of the toner cartridges (104) includes a developing roller (110) for providing toner to an OPC (108). The OPC (108) is contained by a drum cartridge (106) and arranged adjacent to the toner cartridge carousel (102). A toner cartridge push cam (112) and slider (114) are included with the toner cartridge carousel (102) in the present embodiment to move the toner cartridge (106) and developing roller (110) near the OPC (108). The interface between the developing roller (110) and the OPC (108) may include a movable spacer in accordance with the embodiments described above with reference to FIGS. 3–7. Therefore, a temporary space may be maintained between the developing roller (110) and the OPC (108) of the drum cartridge (106) until the color laser printing apparatus (100) is operated and the movable spacer is moved. With the addition of a movable spacer, the toner cartridges (104) and the drum cartridge (106) may be shipped while installed in a color laser printer while advantageously reducing the occurrence of damage to the developing roller (110) and/or the OPC (108).

The drum cartridge (106) also includes a PCR (115) in contact with the OPC (108). The interface between the PCR (115) and the OPC (108) may also include a movable spacer in accordance with the embodiments described above with reference to FIGS. 3–7. Therefore, a temporary space is maintained between the PCR (115) and the OPC (108) of the drum cartridge (106) until the color laser printing apparatus (100) is operated and the movable spacer is moved.

The laser printing apparatus (100) may also include an intermediate transfer unit (116), which may include an intermediate transfer drum or belt (118) for receiving toner from the OPC (108) and transferring the toner to a print medium such as paper. The intermediate transfer unit (116) includes an intermediate transfer roller (120) adjacent to the OPC (108) to facilitate the toner transfer. The interface between the intermediate transfer roller (120) and the OPC (108) may be sensitive to the shocks of shipping and handling. Therefore, the interface between the intermediate transfer roller (120) and the OPC (108) may be spaced from one another with a movable spacer according to the embodiments shown in FIGS. 3–7. Accordingly, the drum cartridge (106) may be installed in the color laser printing apparatus (100) prior to shipment to save space while advantageously reducing the occurrence of damage to the OPC (108), the intermediate transfer belt (118), and/or the intermediate transfer roller (120).

Figure 10:
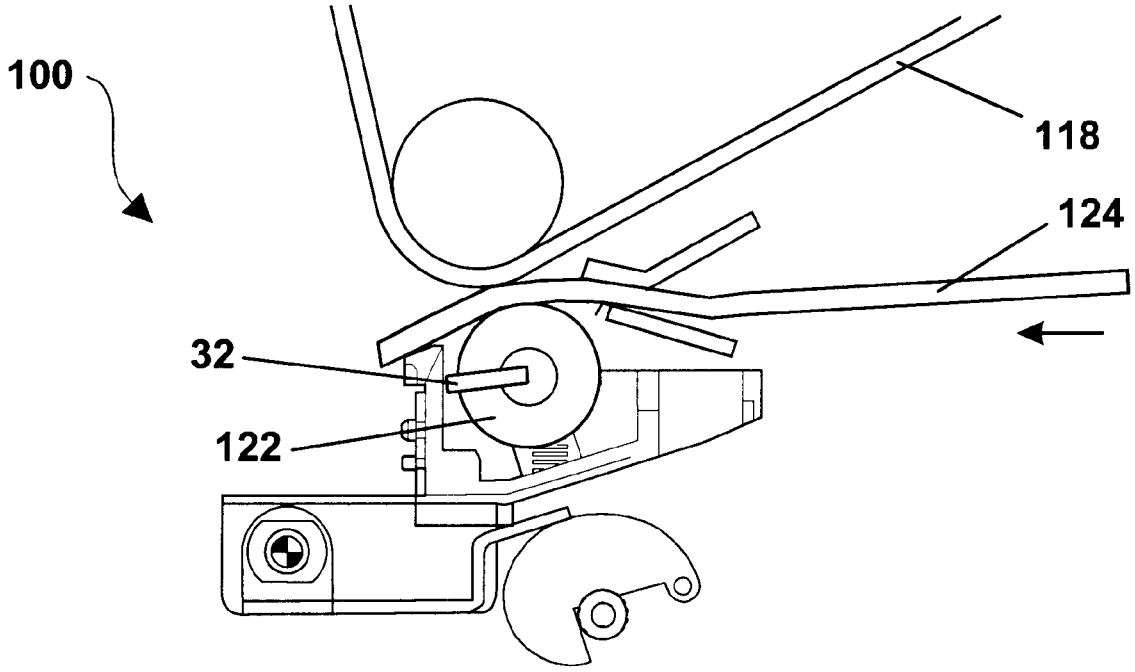
FIG. 10 is another representative view of the color laser printing apparatus of FIG. 9 according to one embodiment of the present invention.

Referring next to FIG. 10 a detail of a print media transfer portion of the laser printing apparatus (100) is shown. The detail illustrates the intermediate transfer belt (118) in proximity to a secondary transfer roller (122). A print media (124) is shown passing through an interface between the intermediate transfer belt (118) and the secondary transfer roller (122). As the print media (124) passes through the interface between the intermediate transfer belt (118) and the secondary transfer roller (122), toner on the intermediate transfer belt (118) is transferred to the print media (124). The interface between the intermediate transfer belt (118) and the secondary transfer roller (122) may be sensitive to the shocks of shipping and handling, therefore, the interface may include a movable spacer in accordance with the embodiments of FIGS. 3–7. Accordingly, prior to first use of the color laser printing apparatus (100), a space is maintained between the intermediate transfer belt (118) and the secondary transfer roller (122). When the color laser printing apparatus (100) is operated, the movable spacer(s) is moved and the color laser printing apparatus may operate normally. With the addition of a movable spacer, the intermediate transfer belt (118) and the secondary transfer roller (122) are less likely to sustain damage during shipping and handling.

In an alternative embodiment, the intermediate transfer belt (118) may be replaced with an intermediate transfer drum, and the movable spacer is arranged to space the intermediate transfer drum from the secondary transfer roller (122).

The preceding description has been presented only to illustrate and describe the invention. It is not intended to be exhaustive or to limit the invention to any precise form disclosed. Many modifications and variations are possible in light of the above teaching.

The embodiments shown were chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. An electrophotographic printing system comprising:

a photoconductive drum;

a transfer roller; and a first spacer creating a gap between said photoconductive drum and said transfer roller wherein said gap is eliminated in response to rotation of said photoconductive drum or said transfer roller;

wherein said first spacer comprises a removable insert disposed between said photoconductive drum and said transfer roller;

wherein said removable insert comprises a frictional surfare in contact with said photoconductive drum whereby said removable insert is forced out from between said photoconductive drum and said transfer roller in said first position in response to rotation of either said photoconductive drum or said transfer roller; and wherein said removable insert is not attached to said any part of said printing system, but drops free when forced out from between said photoconductive drum and said transfer roller.

2. The system of claim 1, wherein said removable insert comprises a Mylar® sheet.

3. The system of claim 2, further comprising a first biasing member between said transfer roller and a first biasing member boss, said first biasing member urging transfer roller toward said photoconductive drum.

4. The system of claim 1, further comprising a charging member and a second movable spacer movable from a first position creating a gap between said charging member and said photoconductive drum, to a second position wherein said gap is eliminated in response to rotation of said photoconductive drum or said charging member.

5. The system of claim 4, wherein said second movable spacer comprises first and second spacer cams pivotally connected at first and second ends, respectively, of said charging member.

6. The system of claim 4, further comprising a second biasing member between said charging member and a second biasing member boss urging said charging member toward said photoconductive drum.

7. An apparatus comprising:

a color laser printer carousel comprising a developing roller having a first movable spacer for temporarily creating a gap between said developing roller and a photoconductive drum, wherein said gap is created by selectively interposing said spacer between said developing roller and said photoconductive drum.

8. The apparatus of claim 7, wherein said first movable spacer further comprises a first floating cam attached to said developing roller and movingly engagable with said photoconductive drum to create said gap.

9. The apparatus of claim 8, wherein said first floating cam comprises a frictional surface for engagement with said photoconductive drum such that said first floating cam rotates out of engagement with said photoconductive drum upon rotation of either of said developing roller or said photoconductive drum; wherein said gap is reduced or eliminated.

10. The apparatus of claim 8, further comprising a second moveable spacer comprising a second floating cam for temporarily maintaining a gap between said developing roller and said photoconductive drum.

11. The apparatus of claim 7, wherein said first movable spacer further comprises a removable insert.

12. The apparatus of claim 7, further comprising a second movable spacer for temporarily creating a gap between said photoconductive drum and an intermediate transfer unit wherein said gap is created by selectively interposing said second spacer between said intermediate transfer unit and said photoconductive drum.

13. The apparatus of claim 12, wherein said intermediate transfer unit comprises an intermediate transfer belt.

14. The apparatus of claim 12, further comprising a third movable spacer for temporarily creating a gap between said intermediate transfer unit and a secondary transfer roller; wherein said intermediate transfer unit and secondary transfer roller define a print medium path and wherein said gap is created by selectively interposing said third spacer between said intermediate transfer unit and said secondary transfer roller.

15. An apparatus comprising:

a color laser printer having a photoconductive drum and an intermediate transfer unit; wherein a first movable spacer is disposed between said photoconductive drum and said intermediate transfer unit for temporarily creating a gap between said intermediate transfer unit and said photoconductive drum.

16. The apparatus of claim 15, further comprising a second movable spacer disposed between said intermediate transfer unit and a secondary transfer roller for temporarily creating a gap between said intermediate transfer unit and said secondary transfer roller, wherein said apparatus is configured to pass print media between said intermediate transfer unit and said secondary transfer roller.

17. The apparatus of claim 16, wherein said intermediate transfer unit comprises a transfer belt driven between a set of rollers.

18. The apparatus of claim 16, further comprising a third movable spacer disposed between said photoconductive drum and a primary charging roller for temporarily creating a gap between said photoconductive drum and said primary charging roller.

19. The apparatus of claim 18, further comprising a fourth movable spacer disposed between said photoconductive drum and a transfer roller for temporarily creating a gap between said photoconductive drum and said transfer roller.

20. An apparatus comprising:

a color laser printer having a primary transfer roller, a photoconductive drum, an intermediate transfer unit, and a secondary transfer roller; wherein a first movable spacer is disposed between said intermediate transfer unit and said secondary transfer roller for temporarily creating a gap between said intermediate transfer unit and said secondary transfer roller.

21. The apparatus of claim 20, further comprising a second movable spacer disposed between said intermediate transfer unit and said photoconductive drum for temporarily creating a gap between said intermediate transfer unit and said photoconductive drum.

22. The apparatus of claim 21, wherein said intermediate transfer unit comprises a transfer belt driven between a set of rollers.

23. The apparatus of claim 21, further comprising a third movable spacer disposed between said photoconductive drum and a primary charging roller for temporarily creating a gap between said photoconductive drum and said primary charging roller.

24. The apparatus of claim 23, further comprising a fourth movable spacer disposed between said photoconductive drum and a transfer roller for temporarily creating a gap between said photoconductive drum and said transfer roller.

25. A method of operating a color laser printing comprising selectively interposing a movable spacer between a developing roller in a color laser printer carousel and a photoconductive drum to protect said developing roller and photoconductive drum from damage.

26. The method of claim 25, further comprising moving said spacer and closing a gap between said developing roller and said photoconductive drum.

27. The method of claim 25, wherein said movable spacer comprises a first floating cam attached to said developing roller, said method further comprising moving said cam with rotation of either said developing roller or said photoconductive drum to close a gap between said developing roller and said photoconductive drum.

28. The apparatus of claim 25, wherein said movable spacer further comprises a removable insert, said method further comprising driving said insert from between said developing roller and said photoconductive drum.

29. The apparatus of claim 28, further comprising allowing said insert to drop free when driven from between said developing roller and said photoconductive drum.

30. A method of operating a color laser printing comprising selectively interposing a movable spacer between an intermediate transfer unit and a photoconductive drum to protect said intermediate transfer unit and photoconductive drum from damage.

31. The method of claim 30, wherein said intermediate transfer unit comprises a transfer belt driven between a set of rollers.

32. The method of claim 30, further comprising interposing a third movable spacer between said photoconductive drum and a primary charging roller for temporarily creating a gap between said photoconductive drum and said primary charging roller.

33. A method of operating a color laser printing comprising selectively interposing a movable spacer between an intermediate transfer unit for receiving a toner image from a photoconductive drum and a secondary transfer roller for transferring said toner image from said intermediate transfer unit to a print medium.

34. The method of claim 33, further comprising interposing a second movable spacer between said intermediate transfer unit and said photoconductive drum for temporarily creating a gap between said intermediate transfer unit and said photoconductive drum.

35. The method of claim 33, wherein said intermediate transfer unit comprises a transfer belt driven between a set of rollers.

* * * * *